United States Patent [19]

Byrne et al.

[11] Patent Number: 4,789,462

[45] Date of Patent: Dec. 6, 1988

[54] REVERSE-GRADED CATALYST SYSTEMS FOR HYDRODEMETALATION AND HYDRODESULFURIZATION

[75] Inventors: Donald F. Byrne, Concord; David R. Johnson, San Francisco; John V. Heyse, Crockett, all of Calif.

[73] Assignee: Chevron Research Company, San Francisco, Calif.

[21] Appl. No.: 913,837

[22] Filed: Sep. 29, 1986

[51] Int. Cl.[4] ..... C10G 45/04

[52] U.S. Cl. ..... 208/213; 208/210; 208/216 PP; 208/227; 208/251 H

[58] Field of Search ..... 208/210, 213, 216 PP, 208/227, 251 H

[56] References Cited

U.S. PATENT DOCUMENTS

| | | | |
|---|---|---|---|
| 3,696,027 | 1/1970 | Bridge | 208/251 H |
| 3,730,879 | 5/1973 | Christman et al. | 208/210 |
| 3,785,967 | 1/1974 | Kinken | 208/213 |
| 3,898,155 | 8/1975 | Wilson | 208/251 H |
| 4,016,067 | 4/1977 | Fischer et al. | 208/210 |
| 4,035,261 | 7/1977 | Hargrove et al. | 208/216 PP |
| 4,048,060 | 9/1977 | Riley | 208/210 |
| 4,054,508 | 10/1977 | Milstein et al. | 208/210 |
| 4,395,328 | 7/1983 | Hensley, Jr. et al. | 208/216 PP |
| 4,395,329 | 7/1983 | Le Page et al. | 208/216 PD |
| 4,421,633 | 12/1983 | Shih et al. | 208/251 H |
| 4,431,525 | 2/1984 | Hensley, Jr. et al. | 208/210 |
| 4,431,526 | 2/1984 | Simpson et al. | 208/210 |
| 4,434,048 | 2/1984 | Schindler | 208/216 PP |
| 4,447,314 | 5/1984 | Banta | 208/251 H |
| 4,454,026 | 6/1984 | Hensley, Jr. et al. | 208/216 PP |
| 4,548,709 | 10/1985 | Bowes et al. | 208/213 |
| 4,552,650 | 11/1985 | Toulhout et al. | 208/251 H |
| 4,622,127 | 11/1986 | Noguchi et al. | 208/216 PP |

*Primary Examiner*—W. J. Shine
*Assistant Examiner*—Helane Myers
*Attorney, Agent, or Firm*—S. R. La Paglia; T. G. De Jonghe; G. D. Haynes

[57] ABSTRACT

We provide reverse-graded catalyst systems which are capable of removing metals and sulfur from a hydrocarbon feedstock. They comprise two or more catalyst layers in which at least two successive catalyst layers characterized as having decreasing desulfurization activity, and increasing average macropore diameter in the direction of hydrocarbon flow. We also disclose a process for using them.

27 Claims, No Drawings

REVERSE-GRADED CATALYST SYSTEMS FOR HYDRODEMETALATION AND HYDRODESULFURIZATION

BACKGROUND OF THE INVENTION

The present invention relates to catalyst systems tailored to remove sulfur and heavy metals from a hydrocarbon feedstock and a process using these systems. The systems are in general terms fixed bed catalyst systems. More particularly, the catalyst systems comprise at least two layers of catalyst particles. We characterize the first layer as having a relatively high desulfurization (HDS) activity compared to the second layer and as having a relatively small average macropore diameter compared to the second layer. Typically, these layers comprise the demetalation (HDM) catalysts which protect a high activity residual oil desulfurization catalyst from premature deactivation by metals deposition. The process which uses these catalyst systems comprises passing a hydrocarbon feedstock containing sulfur and heavy metals over the system at hydrometalation and hydrodesulfurization conditions.

Most heavy crudes contain significant amounts of sulfur and heavy metals. Heavy metals such as nickel and vanadium create problems for refiners by depositing within the catalyst particles. As a result, they block the catalyst pores, and deactivate the catalyst. Workers in the field have proposed a variety of schemes to remove heavy metals from petroleum feedstocks.

One approach is to frequently replace the fouled catalyst, but this is wasteful and results in costly underutilization of the catalyst. In recent years, workers in the field have developed hydrometalation catalysts to protect the more active hydrodesulfurization, hydrodentifrication, and/or hydrocracking catalysts. Schemes of layering varieties of catalysts which differ in pore size, support composition, and metals capacity can result in more efficient use of the individual catalysts.

Conventional processes which remove nickel and vanadium generally have increasing HDS activity, decreasing macroporosity, decreasing average macropore size, and/or decreasing average mesopore size, along the direction of feed flow through the layered bed. We define the term "macropore" to mean catalyst pores or channels or openings in the catalyst particles greater than about 1000 Å in diameter as measured by mercury intrusion. These pores are generally irregular in shape and pore diameters are used to give an approximation of the size of the pore openings. The term "mesopore" is used herein to mean pores having an opening of less than 1000 Å in diameter. Mesopores are, however, usually within the range of 10–300 Å in diameter. We use the term "metals capacity" herein to mean the amount of metals which can be retained by the catalyst under standard demetalation conditions.

Previous workers in the field found macroporosity and the presence of larger mesopores to be strongly related to the capacity of catalyst particles to retain metals removed from a hydrocarbon feed contaminated with nickel and vandium. In the downstream catalyst zones, they prefer predominantly mesoporous catalysts. They found them to have substantially higher catalytic activity for HDS compared to catalysts having lower surface areas and a substantial macroporous structure.

For example, U.S. Pat. No. 3,696,027 to A. G. Bridge, issued Oct. 3, 1982, suggests sequentially contacting the feedstream with a graded system comprising three fixed beds of catalysts having decreasing macroporosity along the normal direction of feed flow. In order to lengthen the HDS run, the catalyst particles of the first bed have at least 30 volume percent macropores; the catalyst particles of the second bed have between 5 and 50 volume percent macropores; and the catalyst particles of third bed have less than 5 volume percent macropores. Bridge also teaches that the three fixed beds have progressively more active HDS catalysts along the direction of hydrocarbon flow. The third catalyst bed (which contains the most active HDS catalyst) contains high surface area particles having an average pore diameter of at least 50 Å, preferably at least 80 Å, and more preferably at least 100 Å.

Unexpectedly, we have discovered that by "reverse-grading" at least part of the HDM catalyst system, we can significantly increase the cycle life of the entire catalyst system. We use the phrase "reverse-graded" system to connote two or more catalyst layers in which at least two successive layers have decreasing HDS activity and increasing average macropore diameter along the direction of hydrocarbon flow. This is in contrast to the usual grading with increasing activity and/or decreasing average macropore diameter along the direction of hydrocarbon flow. By using such an HDM system, we are able to increase sulfur removal and metals removal in the HDM catalyst system. This allows us to increase the amount of HDM catalysts in the entire catalyst system, thereby increasing the metals capacity of the entire catalyst system and extending the life of the catalyst system. Accordingly, it is the primary object of this invention to provide reverse-graded HDM catalyst systems which significantly increase the cycle life of the entire catalyst system.

SUMMARY OF THE INVENTION

This invention concerns reverse-graded HDM catalyst systems, capable of hydrometalation and hydrodesulfurization of a hydrocarbon feedstock. The system comprises two or more catalyst layers in which at least two successive layers are characterized as having decreasing catalyst activity and increasing average macropore diameter in the direction of hydrocarbon flow through the reverse-graded catalyst system.

In accordance with this invention and as a second embodiment, we disclose a process for HDM and HDS of a hydrocarbon feedstock comprising heavy metals and sulfur. The process comprises passing the feedstock, in the presence of hydrogen, through the layers of catalyst particles at HDM and HDS conditions.

DETAILED DESCRIPTION OF THE INVENTION

According to the present invention, we contact a hydrocarbon feedstock under HDM and HDS conditions with a catalyst system, comprising two or more catalyst layers in which at least two successive layers are characterized as having decreasing catalyst activity and increasing average macropore diameter in the direction of hydrocarbon flow.

FEEDSTOCKS

The feedstocks of this invention can be any hydrocarbonaceous feedstocks that contain sulfur heavy metals which are present therein. They typically contain more than 20 ppm of metals such as nickel, vanadium, and iron. In addition, they generally contain more than 1.0 wt. % sulfur and frequently more than 0.1 wt. % nitrogen. They can be crudes, topped crudes, atmospheric or vacuum residua, vacuum gas oil, and liquids from synthetic feed processes, such as liquids from coal, tar sands, or oil shale. For example, we tested an atmospheric residua from a double desalted Maya crude oil which comprised about 4.4 wt. % of sulfur and about 500 ppm of nickel, vanadium, and iron.

CATALYSTS

The catalyst systems of this invention comprise at least two different catalyst layers in the HDM catalyst system. It may be desirable, however, to use more than two layers. We graded them so that the feedstock to be hydroprocessed will contact hydrogen in the presence of a series of HDM and HDS catalysts.

One possible explanation for the benefits observed in reverse-grading is that the first, more active catalyst layer tends to remove the smaller, less diffusionally restricted metal-bearing molecules. The second, less active layer tends to remove metals from the larger metal-bearing molecules of the hydrocarbon feedstock. In this fashion, the first catalyst layer can efficiently load metals which exhibiting relatively high HDS activity. For particular levels of sulfur and heavy metals present in the feedstock, we selected parameters such as porosity, surface activity, shape, and size of the catalyst particles to obtain the desired grading of catalyst activity.

We determined the pore size distribution within the catalyst particle by mercury porosimetry. The mercury intrusion technique is based on the principle that the smaller a given pore the greater will be the mercury pressure required to force mercury into that pore. Thus, if an evacuated sample is exposed to mercury and pressure applied incrementally with the reading of the mercury volume disappearance at each increment, the pore size distribution can be determined. The relationship between the pressure and the smallest pore through which mercury will pass at the pressure is given by the equation:

$$r = -2\sigma \cos \theta / P$$

where r = the pore radius $\sigma$ = surface tension $\theta$ = contact angle

P = pressure

Using pressures up to 60,000 psig and a contact angle of 140°, the range of pore diameters encompassed is 35-20,000 Å.

In a two-layer system, embodied by this invention, we characterize the catalyst for the first layer as having a pore volume distribution of less than 45%, preferably less than 30%, and most preferably less than 25% of its pore volume present in pores having diameters greater than 1000 Å; an average mesopore diameter ranging from about 50 Å to about 300 Å, preferably from about 100 Å to about 250 Å, and most preferably from about 100 Å to about 150 Å; and a surface area ranging from about 100 $m^2/g$ to about 300 $m^2/g$, preferably about 100 $m^2/g$ to about 250 $m^2/g$, and most preferably from about 100 $m^2/g$ to about 200 $m^2/g$.

We characterize the catalyst for the second layer as having a pore volume distribution of at least 25%, preferably at least 30%, and most preferably at least 40% of its pore volume present in pores having diameters greater than 5000 Å; at least 25%, preferably at least 30%, and most preferably at least 40%, of its pore volume present in pores having diameters greater than 100 Å; and a surface area ranging from about 100 $m^2/g$ to about 300 $m^2/g$, preferably from about 100 $m^2/g$ to about 200 $m^2/g$, and most preferably from about 125 $m^2/g$ to about 175 $m^2/g$.

In addition, we also varied surface activity of the catalyst layers to achieve the desired decreasing catalyst activity. We accomplished this by varying the type and amount of catalytic metals loaded onto a given catalyst support. Catalytic metals can be Group VIb or Group VIII metals, as defined by the 1970 rules of the International Union of Pure & Applied Chemistry, from the Periodic Table. In particular, we preferred cobalt and nickel as Group VIII metals, and molybdenum and tungsten as Group VIb metals. We used them singly or in combination, for example, cobalt-molybdenum, cobalt-tungsten, or nickel-molybdenum.

In a two-layer system, embodied by this invention, we characterize the first catalyst of this invention as having at least 0.5 wt. %, preferably at least 1.0 wt. %, and most preferably at least 1.5 wt. % of a Group VIII metal; and at least 3.0 wt. %, preferably at least 5.0 wt. %, and most preferably at least 7.0 wt. % of a Group VIb metal impregnated onto the support.

We characterize the second catalyst of this invention as having less than 10 wt. %, preferably less than 4.0 wt. % and most preferably at less than 2.0 wt. % of a Group VIII metal; and less than 15 wt. %, preferably less than 10 wt. %, and most preferably less than 6.0 wt. % of a Group VIb metal.

Shape and size of the catalyst particles also affect catalyst activity. Larger sized particles inhibit metal penetration and reduce the ratio of exterior surface area to catalyst volume. But larger sized particles also reduce pressure drop in the catalyst bed. Catalyst particle shape also affects pressure drop, metal penetration, the ratio of exterior surface area to catalyst volume, and bed void fraction.

PREPARATION OF CATALYSTS USEFUL IN THE FIRST LAYER

We employed alumina supports in preparing typical first layer catalysts of this invention. For example, suitable supports for these catalysts are detailed in U.S. Pat. No. 4,113,661 to Tamm, issued Sept. 12, 1978, which is incorporated by reference.

Thereafter, the catalytic agents required for typical first layer catalysts may be incorporated into the alumina support by any suitable method, particularly by impregnation procedures ordinarily employed in the catalyst preparation art. Group VIb, especially molybdenum and tungsten, and Group VIII, especially cobalt and nickel, are satisfactory catalytic agents for the present invention.

The amount of catalytic agents (calculated as the pure metal) should be in the range from about 7 to about 10 parts (weight) per 100 parts of the composition. They can be present in the final catalyst in compound form, such as an oxide or sulfide, as well as being present in the elemental form.

PREPARATION OF CATALYSTS USEFUL IN THE SECOND LAYER

We employed an alumina support in preparing typical second layer catalysts of this invention. The supports can be prepared by any conventional process. For example, details of preparing alumina supports of this invention are fully described in U.S. Pat. Nos. 4,392,987 to Laine et al., issued July 12, 1983, and U.S. Pat. No. 4,179,408 to Sanchez et al., issued Dec. 18, 1979. Both are incorporated herein by reference.

Thereafter, the catalytic agents required for typical second layer catalysts may be incorporated into the alumina support by any suitable method, particularly by impregnation procedures ordinarily employed in the catalyst preparation art. Group VIb, especially molybdenum and tungsten, and Group VIII, especially cobalt and nickel, are satisfactory catalytic agents for the present invention.

The amount of catalytic agents (calculated as the pure metal) should be in the range from about 2 to about 8 parts (weight) per 100 parts of the composition. They can be present in the final catalyst in compound form, such as an oxide or sulfide, as well as being present in the elemental form.

Details of incorporating catalytic agents into the alumina support are fully described in U.S. Pat. Nos. 4,341,625, issued July 27, 1982; No. 4,113,661, issued Sept. 12, 1978; and 4,066,574, issued Jan. 3, 1978; all to Tamm. These patents are incorporated herein by reference.

HYDRODEMETALATION AND HYDRODESULFURIZATION CONDITIONS

We operated the first and second catalyst layers as fixed beds. They can be disposed in fluid communication in a single reactor or reaction zone. No other Group VIb or Group VIII metal-containing catalytic material need be present between the two catalyst stages. For example, the stages can be unseparated or separated only by porous support material or reactor internals. It may be desirable, however, to include inexpensive support catalysts between the beds, such as alumina impregnated with less than 10 wt. % total metals, as metals.

The HDM and HDS conditions of the first and second catalyst layers can be the same or different. For particularly heavy feedstocks, hydrogenation conditions should be more severe in the second catalyst layer. In general, they include temperatures in the range of about 600° F. to about 850° F., preferably about 650° F. to about 850° F., most preferably about 700° F. to about 800° F.; total pressures in the range of about 1500 psig to about 3000 psig, preferably from about 1800 psig to about 2800 psig, most preferably from about 2000 psig to about 2400 psig; hydrogen partial pressures in the range of 1200 psig to about 2400 psig, preferably about 1400 psig to about 2250 psig, most preferably about 1600 psig to about 2100 psig; and space velocities ranging from about 0.1 to about 3.0, preferably from about 0.1 to about 2.5, most preferably about 0.1 to about 2.0.

What is claimed is:

1. A process for hydrodemetalating and hydrodesulfurizing a hydrocarbon feedstock using a reverse-graded catalyst system, capable of removing metals and sulfur from a hydrocarbon feedstock, which comprises:

passing said feedstock, in the presence of hydrogen, through said system at hydrodemetalating and hydrdodesulfurizing conditions, wherein said system comprises at least two successive catalyst layers characterized as follows:

(a) said first layer comprises a fixed bed of catalyst particles having less than 45 vol. % of their pore volume in the form of macropores above 1000Å in diameter, having an average mesopore diameter ranging from about 50Å to about 300Å, having a surface area ranging from about 100 $m^2/g$ to about 300 $m^2/g$, having at least 0.5 wt. % of a Group VIII metal, and having at least 3.0 wt. % of a Group VIB metal, and (b) said second layer comprises a fixed bed of catalyst particles having at least 25 vol. % of their pore volume in the form of macropores above 5000Å in diameter, having at least 25 vol. % of their pore volume about 1000Å in diameter, having a surface area ranging from about 100 $m^2/g$ to about 300 $m^2/g$, having less than 10 wt. % of a Group VIII metal, and having less than 15 wt. % of a Group VIB metal.

2. A process according to claim 1, wherein said first and second layers are characterized as follows:

(a) said first layer comprises a fixed bed of catalyst particles having less than 30 vol. % of their pore volume in the form of macropores greater than 1000 Å in diameter, having an average mesopore diameter ranging from about 100 Å to about 250 Å in diameter, having a surface area ranging from about 150 Å to about 250 Å, having at least 1.0 wt. % of a Group VIII metal, and having at least 5.0 wt. % of a Group VIb metal; and (b) said second layer comprises a fixed bed of catalyst particles having at least 30 vol. % of their pore volume in the form of macropores above 5000 Å in diameter, having at least 30 vol. % of their pore volume above 1000 Å in diameter, having a surface area ranging from about 100 $m^2/g$ and about 200 $m^2/g$, having less than 4.0 wt. % of a Group VIII metal, and having less than 10 wt. % of a Group VIb metal.

3. A process according to claim 2, wherein said first and second layers are characterized as follows:

(a) said first layer comprises a fixed bed of catalyst particles having about 25 vol. % of their pore volume in the form of macropores above 1000 Å in diameter, having an average mesopore diameter of about 110 Å in diameter, having a surface area of about 190 $m^2/g$, having at least 1.5 wt. % of a Group VIII metal, and having at least 7.0 wt. % of a Group VIb metal; and (b) said second layer comprises a fixed bed of catalyst particles having at least 40 vol. % of their pore volume in the form of macropores above 5000 Å in diameter, having at least 40 vol. % of their pore volume in the form of macropores above 1000 Å in diameter, having a surface area of about 150 $m^2/g$, having less than 2.0 wt. % of a Group VIII metal, and having less than 6.0 wt. % of a Group VIb metal.

4. A process according to claim 1, which further comprises a third catalyst successive layer characterized as follows:

(c) said third layer comprises a fixed bed of catalyst particles having an average mesopore diameter ranging from about 200 Å to about 260 Å, having an average surface area ranging from about 100 $m^2/g$ to about 140 $m^2/g$, having from about 0.5 to about 2.5 wt. % of a Group VIII metal, and having from about 4.5 to about 8.5 wt. % of a Group VIb metal.

5. A process according to claim 2, which further comprises a third successive catalyst layer characterized as follows:

(c) said third layer comprises a fixed bed of catalyst particles having an average mesopore diameter range from about 215 Å to about 245 Å, having an average surface area ranging from about 115 to about 125 $m^2/g$, having from about 1.0 to about 2.0 wt. % of a Group VIII metal, and having from about 5.5 to about 7.5 wt. % of a group VIb metal.

6. A process according to claim 3, which further comprises a third successive catalyst layer characterized as follows:

(c) said third layer comprises a fixed bed of catalysts particles having an average mesopore diameter of about 230 Å, having an average surface area of about 122 $m^2/g$, having about 6.5 wt. % of a Group VIII metal and having about 1.5 wt. % of a Group VIb metal.

7. A process according to claim 4, which further comprises a fourth successive catalyst layer characterized as follows:

(d) said fourth layer comprises a fixed bed of catalyst particles having high hydrodesulfurization activity.

8. A process according to claim 5, which further comprises a fourth successive catalyst layer characterized as follows:

(d) said fourth layer comprises a fixed bed of catalyst particles having high hydrodesulfurization activity.

9. A process according to claim 6, which further comprises a fourth successive catalyst layer characterized as follows:

(d) said fourth layer comprises a fixed bed of catalyst particles having high hydrodesulfurization activity.

10. A process for hydrodemetalating and hydrodesulfurizing a hydrocarbon feedstock using a reverse-graded catalyst system, capable of removing metals and sulfur from a hydrocarbon feedstock, which comprises:

passing said feedstock, in the presence of hydrogen, through said system at hydrodemetalating and hydrodesulfurizing conditions, wherein said system comprises at least two successive catalyst layers characterized as follows, (a) said first layer comprises a fixed bed of catalyst particles having an average mesopore diameter ranging from about 200 Å to about 260 Å, having an average surface area ranging from about 100 $m^2/g$ to about 140 $m^2/g$, having from about 0.5 to about 2.5 wt. % of a Group VIII metal, and having from about 4.5 to about 8.5 wt. % of a Group VIB metal, and (b) said second layer comprises a fixed bed of catalyst particles having at least 25 vol. % of their pore volume in the form of macropores above 5000 Å in diameter, having at least 25 vol. % of their pore volume above 1000 Å in diameter, having a surface area ranging from about 100 $m^2/g$ to about 300 $m^2/g$, having less than 10 wt. % of a Group VIII metal, and having less than 15 wt. % of a Group VIB metal.

11. A process according to claim 10, wherein said first and second catalyst layers are characterized as follows:

(a) said first layer comprises a fixed bed of catalyst particles having an average mesopore diameter ranging from about 215 Å to about 245 Å, having an average surface area ranging from about 115 to about 125 $m^2g$, having from about 1.0 to about 2.0 wt. % of a Group VIII metal, and having from about 5.5 to about 7.5 wt. % of a Group VIb metal; and (b) said second layer comprises a fixed bed of catalyst particles having at least 30 vol. % of their pore volume in the form of macropores above 5000 Å in diameter, having at least 30 vol. % of their pore volume above 1000 Å in diameter, having a surface area ranging from about 100 $m^2/g$ and about 200 $m^2/g$, having less than 4.0 wt. % of a Group VIII metal, and having less than 10 wt. % of a Group VIb metal.

12. A process according to claim 11, wherein said first and second catalyst layers are characterized as follows:

(a) said first layer comprises a fixed bed of catalyst particles having an average mesopore diameter of about 230 Å, having an average surface area of about 122 $m^2/g$, having about 6.5 wt. % of a Group VIII metal and having about 1.5 wt. % of a Group VI-B metal; and (b) said second layer comprises a fixed bed of catalyst particles having at least 40 vol. % of their pore volume in the form of macropores above 5000 Å in diameter, having at least 40 vol. % of their pore volume in the form of macropores above 1000 Å in diameter, having a surface area of about 150 $m^2/g$, having less than 2.0 wt. % of a Group VIII metal, and having less than 6.0 wt. % of a Group VIb metal.

13. A process according to claim 10, which further comprises a third successive catalyst layer characterized as follows:

(c) said third layer comprises a fixed bed of catalyst particles having an average mesopore diameter ranging from about 200 Å to about 260 Å, having an average surface area ranging from about 100 $m^2/g$ to about 140 $m^2/g$, having from about 0.5 to about 2.5 wt. % of a Group VIII metal, and having from about 4.5 to about 8.5 wt. % of a Group VIb metal.

14. A process according to claim 11, which further comprises a third successive catalyst layer characterized as follows:

(c) said third layer comprises a fixed bed of catalyst particles having an average mesopore diameter rang from about 215 Å to about 245 Å, having an average surface area ranging from about 115 to about 125 $m^2/g$, having from about 1.0 to about 2.0 wt. % of a Group VIII metal, and having from about 5.5 to about 7.5 wt. % of a Group VIb metal.

15. A process according to claim 12, which further comprises a third successive catalyst layer characterized as follows:

(c) said third layer comprises a fixed bed of catalyst particles having an average mesopore diameter of about 230 Å, having an average surface area of about 122 $m^2/g$, having about 6.5 wt. % of a Group VIII metal and having about 1.5 wt. % of a Group VIb metal.

16. A process according to claim 13, which further comprises a fourth successive catalyst layer characterized as follows:

(d) said fourth layer comprises a fixed bed of catalyst particles having high hydrodesulfurization activity.

17. A process according to claim 14, which further comprises a fourth successive catalyst layer characterized as follows:

(d) said fourth layer comprises a fixed bed of catalyst particles having high hydrodesulfurization activity.

18. A process according to claim 15, which further comprises a fourth successive catalyst layer characterized as follows:

(d) said fourth successive layer comprises a fixed bed of catalyst particles having high hydrodesulfurization activity.

19. A process for hydrodemetalating and hydrodesulfurizing a hydrocarbon feedstock using a reverse-graded catalyst system, capable of removing metals and sulfur from a hydrocarbon feedstock, which comprises:

passing said feedstock, in the presence of hydrogen, through said system at hydrodemetalating and hydrodesulfurizing conditions, wherein said system comprises at least two successive catalyst layers characterized as follows, (a) a first catalyst layer comprising a fixed bed of catalyst particles having about 45 vol. % of their pore volume in the form of macropores above 1000 Å in diameter, having an average mesopore diameter ranging from about 50 Å to about 300 Å, having a surface area ranging from about 100 $m^2/g$ to about 300 $m^2/g$, having at least 0.5 wt. % of a Group VIII metal, and having at least 3.0 wt. % and 10.0 wt. % of a Group VIB metal.

(b) a second catalyst layer comprising a fixed bed of catalyst particles having at least 25 vol. % of their pore volume in the form of macropores above 5000 Å in diameter, having at least 25 vol. % of their pore volume above 1000 Å in diameter, having a surface area ranging from about 100 $m^2/g$ to about 300 $m^2/g$, having less than 10 wt. % of a Group VIII metal, and having less than 15 wt. % of a Group VIB metal, and (c) a third catalyst layer comprising a fixed bed of catalyst particles having high hydrodesulfurization activity; comprising passing said feedstock, in the presence of hydrogen, through said layers of catalyst particles at hydrodemetalating and hydrodesulfurizing conditions.

20. A process, according to claim 19, wherein said first and second catalyst layers are characterized as follows:

(a) said first layer comprises a fixed bed of catalyst particles having about 30 vol. % of their pore volume in the form of macropores above 1000 Å in diameter, having an average mesopore diameter ranging from about 100 Å to about 250 Å in diameter, having a surface area ranging from about 150 Å to about 250 Å, having at least 1.0 wt. % of a Group VIII metal, and having at least 5.0 wt. % of a Group VIb metal; and (b) said second layer comprises a fixed bed of catalyst particles having at least 30 vol. % of their pore volume in the form of macropores greater than 5000 Å in diameter, having at least 30 vol. % of their pore volume in the form of macropores above 1000 Å in diameter, having a surface area ranging from about 100 $m^2/g$ and about 200 $m^2/g$, having less than 4.0 wt. % of a Group VIII metal, and having less than 10 wt. % of a Group VIb metal.

21. A process according to claim 20, wherein said first and second catalyst layers are characterized as follows:

(a) said first layer comprises a fixed bed of catalyst particles having about 25 vol. % of their pore volume in the form of macropores above 1000 Å in diameter, having an average mesopore diameter of about 110 Å in diameter, having a surface area of about 190 $m^2/g$, having at least 1.5 wt. % of a Group VIII metal, and having at least 7.0 wt. % of a Group VIb metal; and (b) said second layer comprises a fixed bed of catalyst particles having at least 40 vol. % of their pore volume in the form of macropores above 5000 Å in diameter, having at least 40 vol. % of their pore volume in the form of macropores above 1000 Å in diameter, having a surface area of about 150 $m^2/g$, having less than 2.0 wt. % of a Group VIII metal, and having less than 6.0 wt. % of a Group VIb metal.

22. A process for hydrometalating and hydrodesulfurizing a hydrocarbon feedstock using a reverse-graded catalyst system, capable of removing metals and sulfur from a hydrocarbon feedstock, comprising:

passing said feedstock, in the presence of hydrogen, through said system at hydrodemetalating and hydrodesulfurizing conditions, wherein said system comprises at least two successive catalyst layers characterized as follows, (a) a first catalyst layer comprising a fixed bed of catalyst particles having an average mesopore diameter ranging from about 200 Å to about 260 Å, having an average surface area ranging from about 100 $m^2/g$, to about 140 $m^2/g$, having from about 0.5 to about 2.5 wt. % of a Group VIII metal, and having from about 4.5 to about 8.5 wt. % of a Group VIB metal, (b) a second catalyst layer comprising a fixed bed of catalyst particles having at least 25 vol. % of their pore volume in the form of macropores greater than 5000 Å in diameter, having at least 25 vol. % of their pore volume above 1000 Å in diameter, having a surface area ranging from about 100 $m^2/g$ to about 300 $m^2/g$, having less than 10 wt. % of a Group VIII metal, and having less than 15 wt. % of a Group VIB metal, and (c) a third catalyst layer comprising a fixed bed of catalyst particles having high hydrodesulfurization activity; comprising passing said feedstock, in the presence of hydrogen, through said layers of catalyst particles at hydrodemetalating and hydrodesulfurizing conditions.

23. A process according to claim 22, wherein said first and second catalyst layers are characterized as follows:

(a) said first layer comprises a fixed bed of catalyst particles having an average mesopore diameter ranging from about 215 Å to about 245 Å, having an average surface area ranging from about 115 to about 125 $m^2/g$, having from about 1.0 to about 2.0 wt. % of a Group VIII metal, and having from about 5.5 to about 7.5 wt. % of a Group VIb metal; and (b) said second layer comprises a fixed bed of catalyst particles having at least 30 vol. % of their pore volume in the form of macropores above 5000 Å in diameter.

24. A process according to claim 23, wherein said first and second catalyst layers are characterized as follows:

(a) said first layer comprises a fixed bed of catalyst particles having an average mesopore diameter of about 230 Å, having an average surface area of about 122 $m^2/g$, having about 6.5 wt. % of a Group VIII metal, and having about 1.5 wt. % of a Group VIb metal; and (b) said second layer comprises a fixed bed of catalyst particles having at least 40 vol. % of their pore volume in the form of macropores greater than 5000 Å in diameter, having at least 40 vol. % of their pore volume in the form of macropores above 1000 Å in diameter, having a surface area of about 150 $m^2/g$, having less than 2.0 wt. % of a Group VIII metal, and having less than 6.0 wt. % of a Group VIb metal.

25. A process according to claim 1, 2, 3, 4, 5, 6, 7, 8, 9, 10, 11, 12, 13, 14, 15, 16, 17, 18, 19, 20, 21, 22, 23, or 24 wherein said hydrometalating and hydrodesulfurizing conditions comprise:

(a) temperature ranging from about 600° F. to about 850° F.;

(b) total pressure ranging from about 1500 psig to about 3000 psig;

(c) hydrogen partial pressure ranging from about 1200 psig to about 2400 psig; and (d) space velocity ranging from about 0.1 to about 3.0.

26. A process according to claim 25, wherein said hydrodemetalating and hydrodesulfurizing conditions comprise:

(a) temperature ranging from about 650° F. to about 850° F.;

(b) total pressure ranging from about 1800 psig to about 2800 psig;

(c) hydrogen partial pressure ranging from about 1400 psig to about 2250 psig; and (d) space velocity ranging from about 0.1 to about 2.5.

27. A process according to claim 26, wherein said hydrodemetalating and hydrodesulfurizing conditions comprise:

(a) temperature ranging from about 700° F. to about 800° F.;

(b) total pressure ranging from about 2000 psig to about 2400 psig;

(c) hydrogen partial pressure ranging from about 1600 psig to about 2100 psig; and (d) space velocity ranging from about 0.1 to about 2.0.

* * * * *